US010807789B2

(12) United States Patent
Gabriel

(10) Patent No.: US 10,807,789 B2
(45) Date of Patent: Oct. 20, 2020

(54) THERMAL-TRANSFER CONTAINER SLEEVE SYSTEM AND METHOD

(71) Applicant: Gameel Gabriel, Covington, LA (US)

(72) Inventor: Gameel Gabriel, Covington, LA (US)

( * ) Notice: Subject to any disclaimer, the term of this patent is extended or adjusted under 35 U.S.C. 154(b) by 55 days.

(21) Appl. No.: 15/802,753

(22) Filed: Nov. 3, 2017

(65) Prior Publication Data

US 2019/0135523 A1 May 9, 2019

(51) Int. Cl.

| | |
|---|---|
| ***B65D 81/38*** | (2006.01) |
| ***A47G 19/22*** | (2006.01) |
| ***F25D 3/08*** | (2006.01) |

(52) U.S. Cl.

CPC ..... *B65D 81/3886* (2013.01); *A47G 19/2288* (2013.01); *B65D 81/3879* (2013.01); *F25D 3/08* (2013.01); *F25D 2303/0841* (2013.01); *F25D 2303/0843* (2013.01); *F25D 2303/0846* (2013.01); *F25D 2331/803* (2013.01); *F25D 2331/805* (2013.01)

(58) Field of Classification Search

CPC ..... B65D 81/3886; B65D 81/3879; B65D 81/38; B65D 81/3876; B65D 81/389; B65D 81/3839; A47G 19/127; A47G 19/2288; A47G 2023/0291; A47G 2023/0283; A47G 23/04

USPC .... 220/739, 592.17, 592.16, 592.24, 592.25, 220/592.2, 903

See application file for complete search history.

(56) References Cited

U.S. PATENT DOCUMENTS

| | | | | |
|---|---|---|---|---|
| 2,576,698 | A * | 11/1951 | Russum | F01B 17/04 428/75 |
| 3,374,298 | A * | 3/1968 | Studen | B29C 44/507 264/41 |
| 3,603,106 | A | 9/1971 | Ryan et al. | |
| 4,388,813 | A | 6/1983 | Gardner et al. | |
| 4,399,668 | A * | 8/1983 | Williamson | B65D 81/3883 215/12.1 |
| 4,660,594 | A * | 4/1987 | Gocze | B65D 81/3823 137/375 |
| 4,870,837 | A | 10/1989 | Weins | |
| 4,871,597 | A | 10/1989 | Hobson | |
| 4,972,759 | A * | 11/1990 | Nelson | F24H 1/182 122/19.2 |

(Continued)

FOREIGN PATENT DOCUMENTS

WO WO2007099114 9/2007

*Primary Examiner* — Robert Poon

(74) *Attorney, Agent, or Firm* — Buckley Law Firm, LLC; William P. Buckley

(57) ABSTRACT

A thermal-transfer container sleeve system and method for warming, cooling, or maintaining the temperature of a fluid inside a thermally-conductive container. The thermal-transfer container sleeve is portable, is non-electric and non-fuel-burning, and is not itself a fluid container, which might not be allowed in some places or circumstances. The thermal-transfer container sleeve is easily pre-heated or pre-cooled with standard kitchen equipment. The thermal-transfer container sleeve provides high-thermal-capacitance units attached to the inside of an insulation sleeve in a way that maximizes thermal contact with the thermally-conductive container, but provides additional surface area when not mounted upon a thermally-conductive container to increase the efficiency of pre-heating or pre-cooling.

8 Claims, 7 Drawing Sheets

(56) References Cited

U.S. PATENT DOCUMENTS

| | | | | |
|---|---|---|---|---|
| 4,989,418 | A * | 2/1991 | Hewlett | B65D 81/3883 62/372 |
| 5,322,181 | A * | 6/1994 | Nelson | F16L 59/024 206/523 |
| 5,845,804 | A * | 12/1998 | Prescott | B65D 81/3879 220/739 |
| 6,601,728 | B1 * | 8/2003 | Newkirk | A47G 23/0216 220/739 |
| 8,056,757 | B2 | 11/2011 | Mansour et al. | |
| 9,700,951 | B2 | 7/2017 | Matsuzaki et al. | |
| 2007/0068958 | A1 * | 3/2007 | Besser | B65D 81/3876 220/737 |
| 2010/0051628 | A1 * | 3/2010 | Fang | A47J 36/36 220/592.24 |
| 2010/0072268 | A1 * | 3/2010 | Johnson | B65D 81/3869 229/403 |
| 2011/0192859 | A1 | 8/2011 | Belford | |
| 2012/0228318 | A1 * | 9/2012 | Martin | A47G 23/0216 220/739 |
| 2013/0200089 | A1 * | 8/2013 | Vidal | B23P 11/00 220/739 |

* cited by examiner

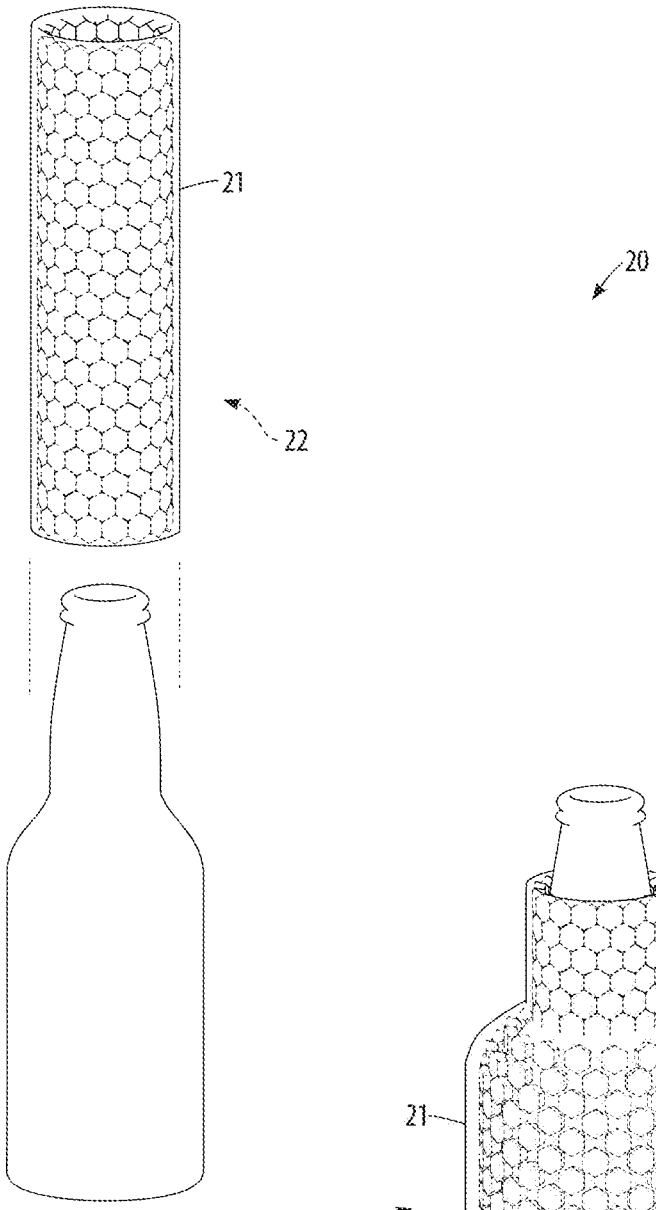
FIG. 5A
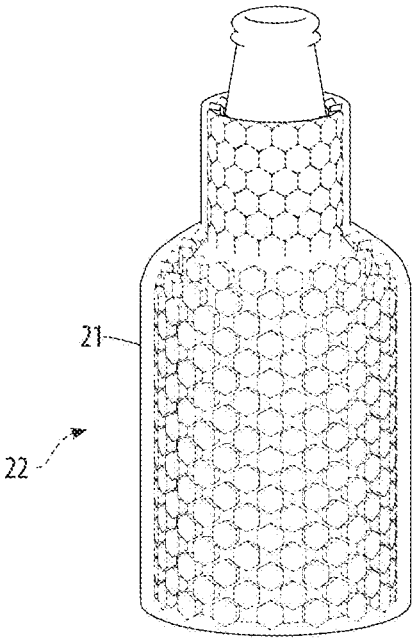
FIG. 5B
FIG. 5

THERMAL-TRANSFER CONTAINER SLEEVE SYSTEM AND METHOD

BACKGROUND

This invention relates to temperature-insulating containers and provides a thermal-transfer container sleeve for warming, cooling, or maintaining the temperature of a fluid inside a thermally-conductive container.

Many substances, including fluids and gels, have a temperature or range of temperature for optimum use. Some beverages are meant to be consumed hot or warm, while others are meant to be consumed cold. Additionally, certain fluid products may be more effective at a certain temperature, and some fluid products may only be used safely at a specified temperature. For example, some fluids, such as blood, must be kept cold during storage, transfer, and handling, but then must be brought up to a warmer temperature just before use in a transfusion. In such a case, the usual method available to health-care providers is to warm the fluid in a microwave oven. However, an ambulance or medic in the field may not have such a microwave oven available. Similarly, a beverage purchased in a can or bottle, at a location away from the home or office, might not be at the temperature that a customer desires, and the customer would want to make it warmer or cooler in a quick and portable way. When cold beverages are consumed in warm or hot environments, the beverage tends to warm up, and when hot beverages are consumed in cold environments or consumed slowly, the beverage tends to cool off.

Although a thermally insulated beverage container might be useful, many times beverages are not sold in insulated containers, and some venues do not allow any outside beverages or beverage containers to be brought into the venue. Further, an insulated container cannot actively put heat into, or draw heat out of, the contained fluid. Although there are portable ways to heat and cool fluids using electricity or fuel, such as butane, devices having electrical components or fuel storage might not be allowed, or might otherwise be undesirable or unsafe, in some locations and circumstances.

Several inventors have attempted to provide various solutions to transferring heat in relation to a canned or bottled drink.

For example, U.S. Pat. No. 8,056,757 was issued to assignee King Fand University of Petroleum and Minerals on Nov. 15, 2011, covering a "Hot Beverage Cup Sleeve." The concept, invented by Rached Ben Mansour and Muhammad A. Hawwa, discloses a hot beverage cup and a sleeve that bring together two modes of heat transfer, conduction and radiation. The sleeve has an inner face with a plurality of high reflectivity surfaces for radiating heat back to the cup. The sleeve also has a plurality of insulating members for containing insulating air. Each of the insulating members is positioned to space the high reflectivity surfaces away from the cup. A low emissivity film can be adhered to the cup without touching the insulating members. The film can also be attached to the sleeve facing but spaced from the high reflectivity surfaces. This cup and sleeve arrangements minimize thermal contact and reduce heat transfer. Thus, the hot beverage cup and sleeve protect a person's hand as well as extend the time of keeping the beverage hot.

U.S. Publication No. 2011/0192859, published by inventor Rita Belford on Aug. 11, 2011, discloses a "Beverage Container Sleeve and Method of Making and Using Same." Per the disclosure of this Belford publication, an improved cooling and/or heating system for a beverage container, a method of manufacturing the container sleeve, and a method of using the container sleeve are provided. The improved container sleeve is configured to cover a beverage container and actively cool and/or heat the container while helping to maintain the temperature of the beverage once it is cooled or heated. The cover includes a flexible insulating material with a cooling and/or heating device positioned on the inner surface.

U.S. Pat. No. 4,388,813, issued on Jun. 21, 1983 to assignee Aurora Design Associates, Inc., covers a "Server for Wine Bottles and the Like" The product, as shown below, was conceived by inventors James H. Gardner and Noel H. de Nevers and discloses a server for chilled wine and similar beverages or foods includes a generally cylindrically-shaped side wall into which a bottle or other container may be placed. The side wall is constructed of a heat conductive material such as aluminum, copper, alloys thereof, and so forth, of sufficient thickness to conduct heat as needed in its circumferential direction. The server also includes an ice receptacle formed to surround a side portion of the side wall to hold ice in contact with the side wall. The side wall acts to present the wine container with a surface which is at or below the temperature of the wine. This substantially eliminates the transfer of heat by radiation to the wine container. The server also minimizes conductive and/or convective heat transfer between the wine bottle and the surroundings.

International Publication No. 2007/099114 was published by Arcelik Anonim Sirketi on Sep. 7, 2007, discloses a cooling device characterized by a can holder situated in such cooling device, and can be produced with ease as a result of a shaping process implemented on both sides of a thin sheet and presents a cost advantage by making use of a small amount of material. More specifically, it is produced by bending and warping a metal sheet or shaping plastic by means of a mold in a wavy or sinusoidal shape. It has one or more containers with a can disposed in each one, arranged on both the front and back sides of the sheet, the consecutive ones being arranged on different sides of the sheet.

U.S. Pat. No. 4,870,837 was issued on Oct. 3, 1989 to inventor Janine J. Weins, covering a "Device for Maintaining the Chill on a Bottle of Wine." The disclosed invention is directed to a vessel having a high heat capacity sidewall for use in maintaining the chill on a container such as a bottle of wine. The base of the vessel may be provided with an insulating layer to limit heat conductivity between the vessel and a surface on which the vessel may be placed. In a preferred embodiment of the present invention, the vessel is provided with a closure means. In another preferred embodiment the vessel is provided with an absorbent layer so that when the container is removed from the vessel it will be wiped of condensed moisture. In yet another embodiment of the present invention, the vessel is provided with high heat capacity fins to increase the thermal conductivity between a container placed within the vessel and the vessel sidewall. The fins may further serve to constrict the movement of a container placed within the vessel. In a preferred embodiment, the sidewall of the vessel contains a fluid having a melting point near the temperature at which it is desired to maintain the container which may be placed within the vessel. If the container is used to store white wine, the sidewall of the vessel may be filled with a fluid having melting point of about 0° C. to 7° C. If the vessel is used to store red wine, the sidewall may be filled with a fluid having a melting point of between about 15° C. and 22° C. The disclosed invention is compact and stable, is less bulky than ice buckets, and does not rely on ice and water to maintain the chill on a container.

U.S. Pat. No. 4,871,597, issued on Oct. 3, 1989 to inventor Michael A. Hobson, covers a "Light-Weight Multi-Layer Insulating Enclosure." This '597 patent specially covers a light-weight multi-layer insulating enclosure comprised of four different layers of materials to provide maximum insulation for containers ranging from relatively rigid to relatively flexible construction. The improved insulating qualities of the present invention are achieved through the use of an inner-most fabric liner layer, a second inner-most insulating layer which includes a polymeric foam, a third inner-most metalized polymer film reflective layer, and an outer-most fabric mesh layer. The enclosure is light-weight, collapsible and removable.

U.S. Pat. No. 3,603,106, as issued on Sep. 7, 1971 to inventors John W. Ryan and Wallace H. Shapero, for a "Thermodynamic Container" relates to a food and beverage container, and more particularly to a container of the thermodynamic type capable of regulating the temperature of the food and beverage therein. The thermodynamic container comprises an outer wall of low thermal conductivity separated by an insulating material from an inner metal capsule of very high thermal conductivity having a heat-storage material disposed therein. Beverages too hot to drink melt the heat-storage material which in turn cools the beverage to a drinkable temperature within two minutes. Heat lost during the beverage's cooling is then returned to the beverage to maintain it at a drinkable temperature as the heat-storage material re-solidifies.

While the examples described above may be satisfactory in some circumstances, there remains a need for a thermal-transfer method that is portable, is not itself a fluid container, and can be prepared for use by pre-heating or pre-cooling with equipment available in a standard home or office kitchen.

SUMMARY OF THE INVENTION

This invention provides a thermal-transfer container sleeve system and method for warming, cooling, or maintaining the temperature of a fluid inside a thermally-conductive container. The thermal-transfer container sleeve is portable, is non-electric and non-fuel-burning, and is not itself a fluid container, which might not be allowed in some places or circumstances. The thermal-transfer container sleeve is easily pre-heated or pre-cooled with standard kitchen equipment. The thermal-transfer container sleeve provides high-thermal-capacitance units attached to the inside of an insulation sleeve in a way that maximizes thermal contact with the thermally-conductive container, but provides additional surface area when not mounted upon a thermally-conductive container to increase the efficiency of pre-heating or pre-cooling.

BRIEF DESCRIPTION OF DRAWINGS

Reference will now be made to the drawings, wherein like parts are designated by like numerals, and wherein:

FIGS. 5A and 5B illustrate a stretch embodiment of the thermal-transfer container sleeve of the invention in use on a bottle, with FIG. 5A illustrating the stretch embodiment of the thermal-transfer container sleeve of the invention prior to application on a bottle, and FIG. 5B illustrating the stretch embodiment of the thermal-transfer container sleeve applied to and stretched around the outside of a bottle;

DETAILED DESCRIPTION OF THE INVENTION

Referring to FIGS. 1A through 1D, the thermal-transfer container sleeve system 10 of the invention is shown in use on a beverage container. The fluid containers appropriate for this thermal-transfer container sleeve 10 are made of thermally-conductive material, such as metal, plastic, paper, or glass, in contrast to an insulating material, which would tend to prevent the desired thermal transfer.

The thermal-transfer container sleeve system 10 provides an insulating sleeve 1 of sheet material such as neoprene, silicone, or similar rubbers or plastics. The sheet material is insulating, to prevent or lessen thermal transfer to the outside environment. Silicone can be made extremely heat-resistant, and accordingly may be a preferred choice for uses involving pre-heating of the thermal-transfer container sleeve system 10 to a high temperature. In use, the insulating sleeve 1 has an inside face or surface, toward the fluid container, and an outside face or surface.

On the inside of the insulating sleeve are arrayed several high-thermal-capacitance units 2, which, in use, will be in thermal contact with the fluid container. The high-thermal-capacitance units are adapted to transfer thermal energy with an outside heat source or conventional sink. The high-thermal-capacitance units 2 are made from material having a high thermal capacitance, also called thermal mass and heat capacity. Keeping in mind that only heat is energy that can move, and becoming cold means giving up heat, a material with high thermal capacitance will take in heat, effectively store that heat for a time, and give up heat slowly. An illustrative example is a clay brick heated all day by the sun, still giving off heat long after the sun sets. Suitable high-thermal-capacitance materials for making the high-thermal-capacitance units 2 are metals, such as copper, brass, and aluminum, and ceramics, which are made from clay. These materials are light enough to be portable, are mostly affordable, excluding copper, and are not dangerous or toxic in this type of use.

Figures 1, 1A, 1B, 1C, 1D:
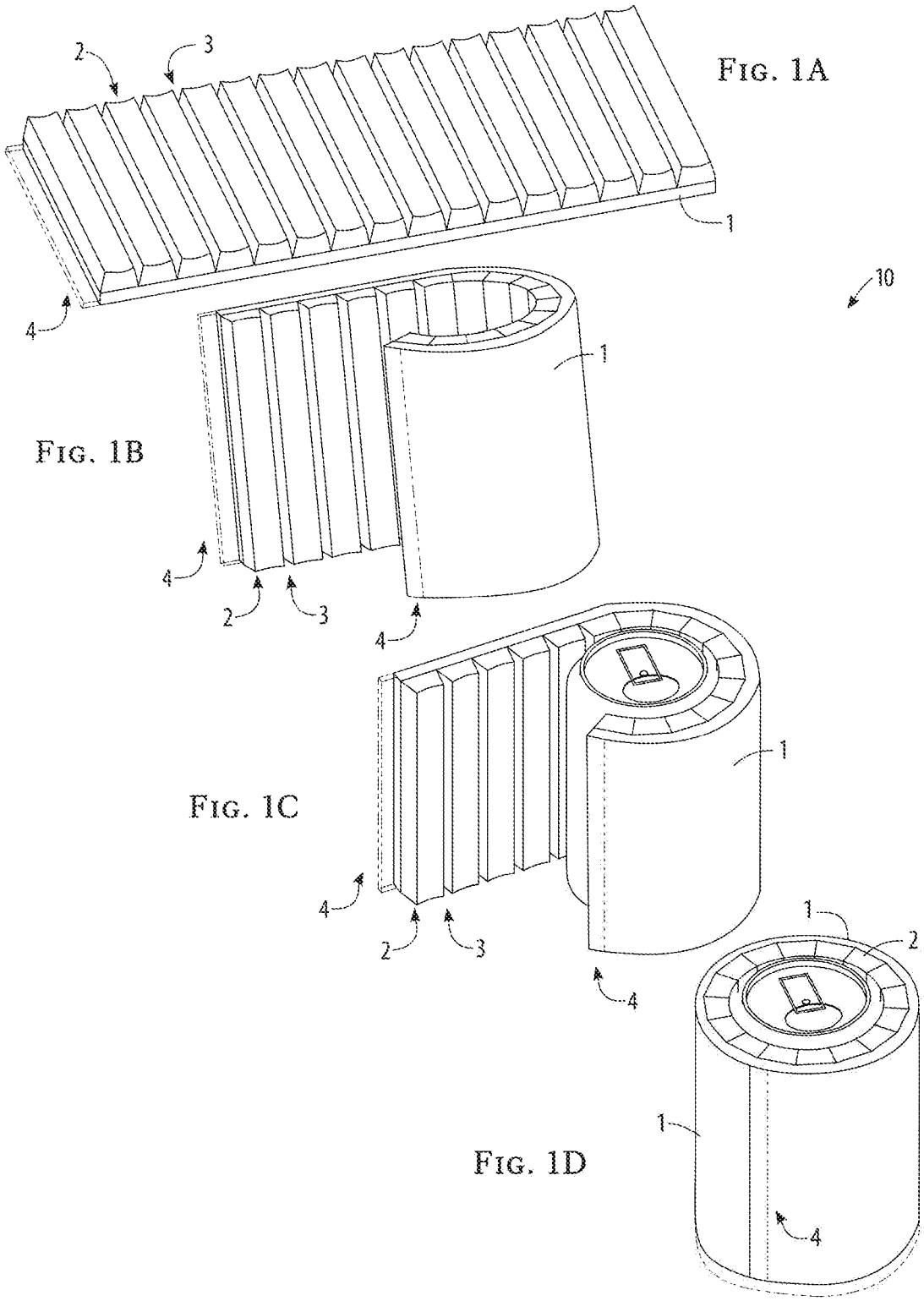
FIGS. 1A through 1D illustrate the thermal-transfer container sleeve of the invention in use on a beverage container, with FIG. 1A illustrating the thermal-transfer container sleeve of the invention laid flat, prior to use on a beverage container, FIG. 1B illustrating the thermal-transfer container sleeve of the invention partially rolled, FIG. 1C illustrating the thermal-transfer container sleeve of the invention partially rolled around a beverage container, and FIG. 1D illustrating the thermal-transfer container sleeve of the invention fully rolled around a beverage container.

In the illustrated embodiment, the high-thermal-capacitance units 2 are formed as bars and are arrayed with long dimensions lining up with the long dimension, or longitudinal axis, of the fluid container. The high-thermal-capacitance units 2 have modified "trapezoidal" cross-sections, with the face attached to the insulating sleeve being wider than the face which makes contact with the fluid container. The inner faces of the high-capacitance units 2 have an arcuate configuration complimentary to the curvature of a container, such as the curvature of a conventional bottle or a can. The outside faces of the high-capacitance units 2 have similarly curved or arcuate faces, albeit with the arc having greater radius that the arc of the inner faces. When the thermal-transfer container sleeve system 10 is wrapped around a fluid container, as shown in FIGS. 1C and 1D, the inner faces of the high-thermal-capacitance units 2 are brought together, and an essentially gap-free array of high-thermal-capacitance units 2 make contact with the outer surface of the fluid container.

The high-thermal-capacitance units 2 come into contact with each other, combining their thermal masses and minimizing any loss of thermal energy through air gaps. The physical and thermal contact among the high-thermal-capacitance units 2 promotes maintenance of an even temperature or rate of thermal transfer throughout all of the high-thermal-capacitance units 2. Therefore, the thermal-transfer container sleeve 10 applies a consistent amount of energy distributed over almost all of the container, and therefore avoids undesirable effects such as localized overheating or scorching, or localized over-cooling or freezing.

When the thermal-transfer container sleeve system 10 is laid flat or opened up, the air gaps re-appear, and become useful thermal-transfer gaps 3 to speed up the pre-heating or pre-cooling process in anticipation of the next use. An article put into a home freezer will freeze faster if cold air is allowed to circulate around the article. The thermal-transfer gaps 3 promote thermal transfer by providing greater exposed surface area, and circulation space, around the high-thermal-capacitance units 2.

The illustrated embodiment of the thermal-transfer container sleeve system 10 provides a sleeve closure 4 or closures to hold the sleeve closed against the fluid container, and to allow laying flat while pre-heating or pre-cooling. Such closures are known in the art, and can incorporate hook-and-loop tape, snaps, zippers, and magnetic closures.

Figure 2:
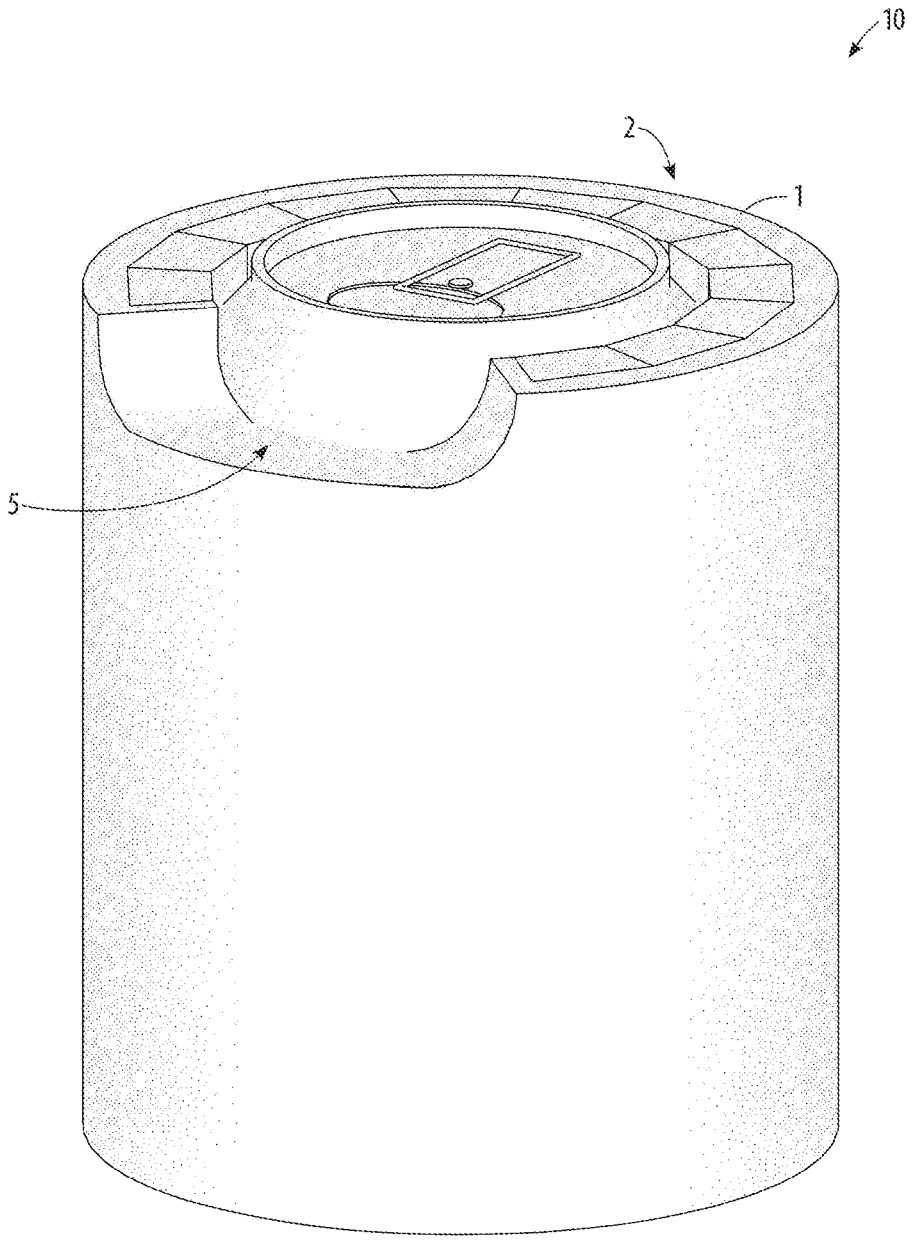
FIG. 2 is a perspective view of an embodiment of the thermal-transfer container sleeve of the invention having an access opening.

Referring to FIG. 2, optionally, an access opening 5 is provided to accommodate a person's mouth when drinking from the container. The cutout 5 can be configured with straight sides or curved sides for the comfort of the user.

Figure 3:
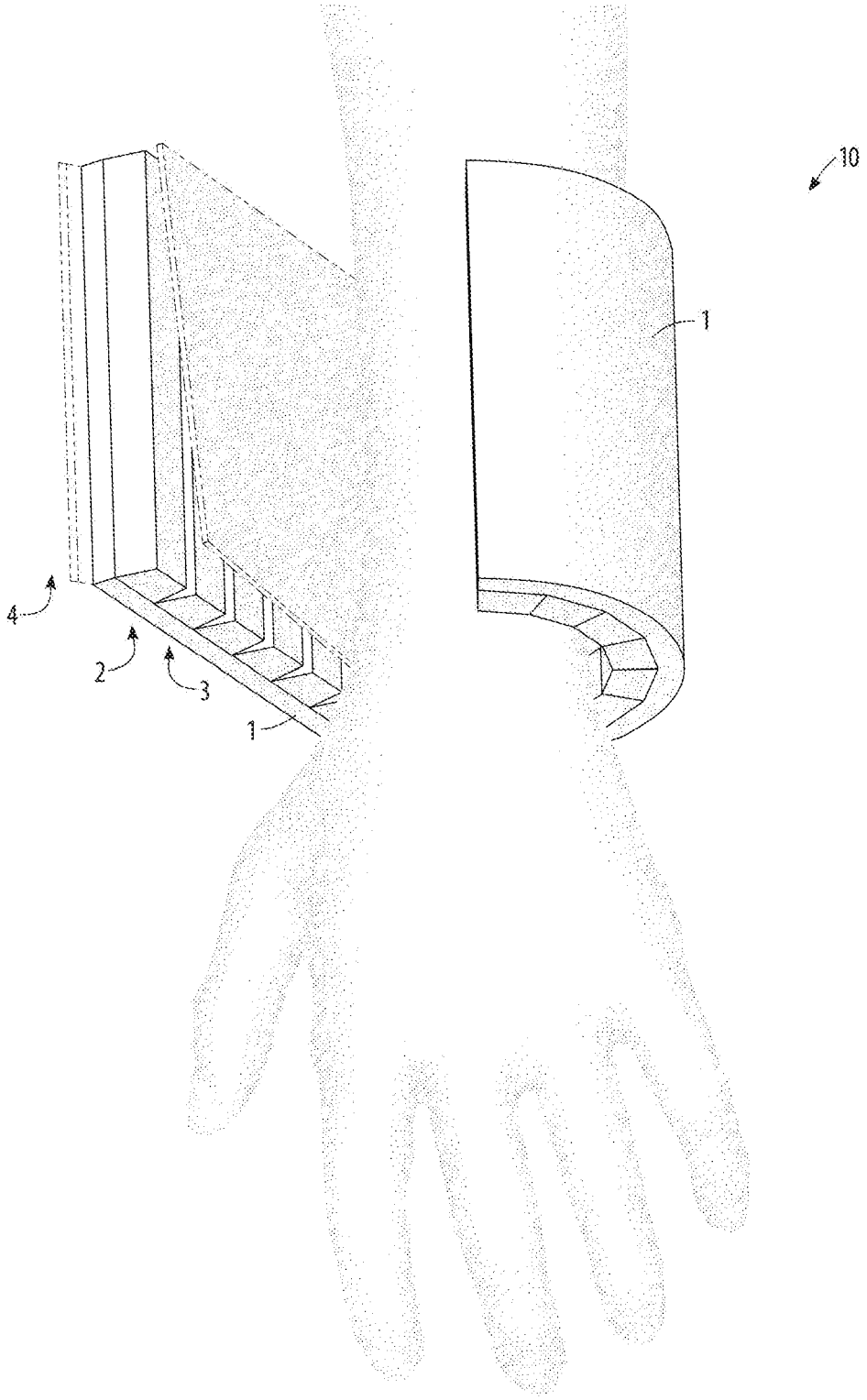
FIG. 3 is a schematic view of the thermal-transfer container sleeve of the invention in use on a person's arm and wrist.

Referring to FIG. 3, the thermal-transfer container sleeve system 10 can also be used to provide heat or cold for medical or therapeutic uses. For such uses, it may be preferable to choose a material for the high-thermal-capacitance units 2 that exhibit a longer, more gradual and gentle addition or subtraction of heat, in order to prevent damage to skin and tissue. A protective cloth can be placed between the high-capacitance units 2 and the user's skin. If the system 10 is used as a heating pad, it will provide an added advantage that other heating pads do not; by wetting the protective cloth, it will provide moist heat, as opposed to dry heat, which is more desirable in many cases.

Figure 4:
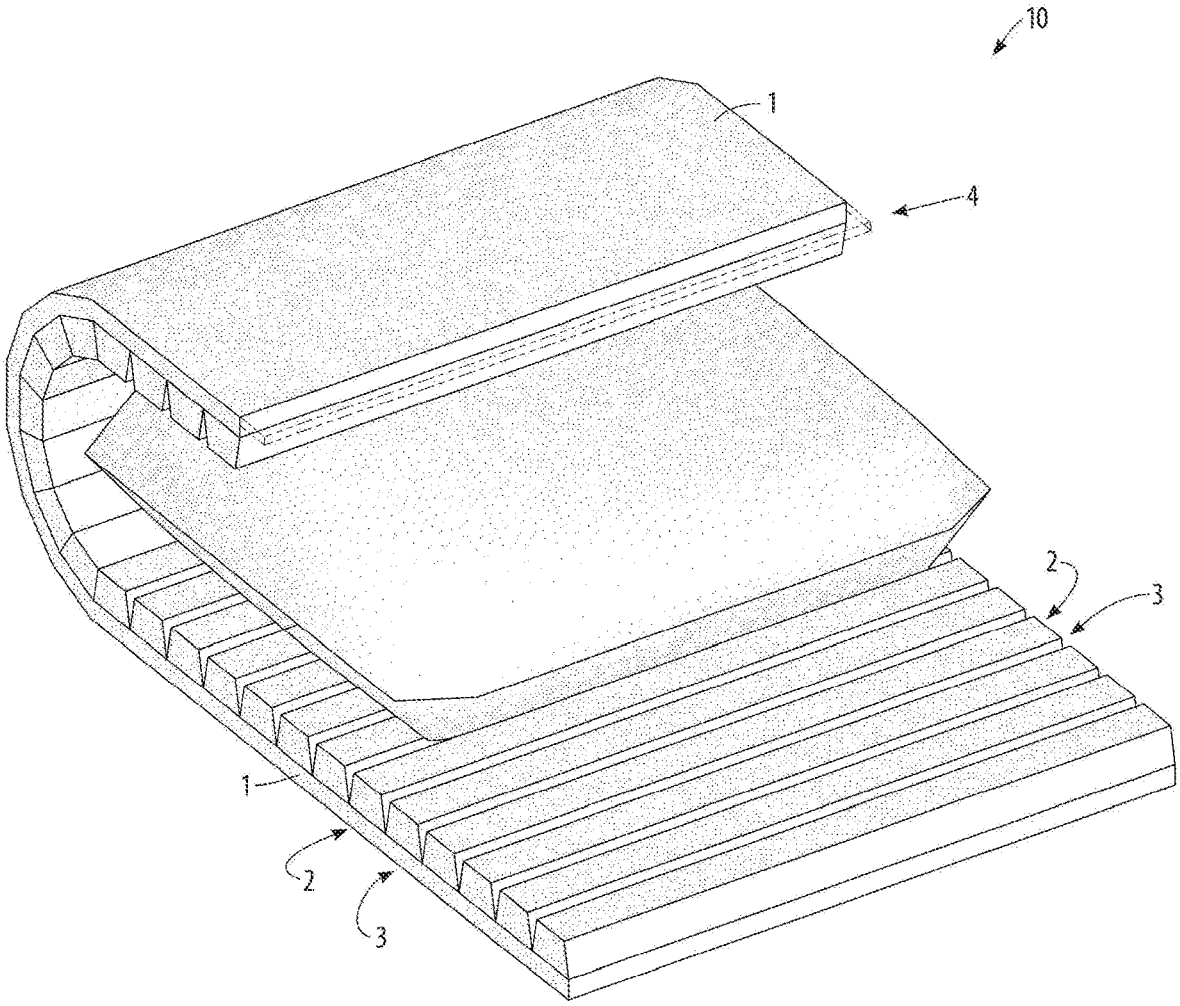
FIG. 4 is a schematic view of the thermal-transfer container sleeve of the invention in use to warm a bag of blood for transfusion.

Referring to FIG. 4, the thermal-transfer container sleeve system 10 can be used to bring blood and other fluids up to a useable temperature in a quick but controlled way. Blood must be kept cold up until time of transfusion, but must be warmed just before use, often under time-sensitive conditions, and sometimes away from heating devices such as ovens. The thermal-transfer container sleeve system 10 makes contact with most of the surface area of the bag-like fluid container, and transfers heat, in this case, into the fluid in an even manner, avoiding localized overheating which would damage the blood.

Referring to FIGS. 5A and 5B, a stretch embodiment 20 of the thermal-transfer container sleeve is provided, which is appropriate for fluid containers having irregular profiles, such as certain beverage bottles. In the stretch embodiment depicted in FIGS. 5A and 5B, the insulating sleeve system comprises an insulating stretch sleeve 21, of a material such as neoprene. Arrayed upon the inside surface of the insulating stretch sleeve 21 are several separate high-thermal-capacitance units 22 which are not long bars of high-thermal-capacitance material, but are instead smaller separate units which can move in relation to each other as the insulating stretch sleeve 21 expands or contracts to follow the profile of the fluid container.

Figures 6, 6A, 6B, 6C:
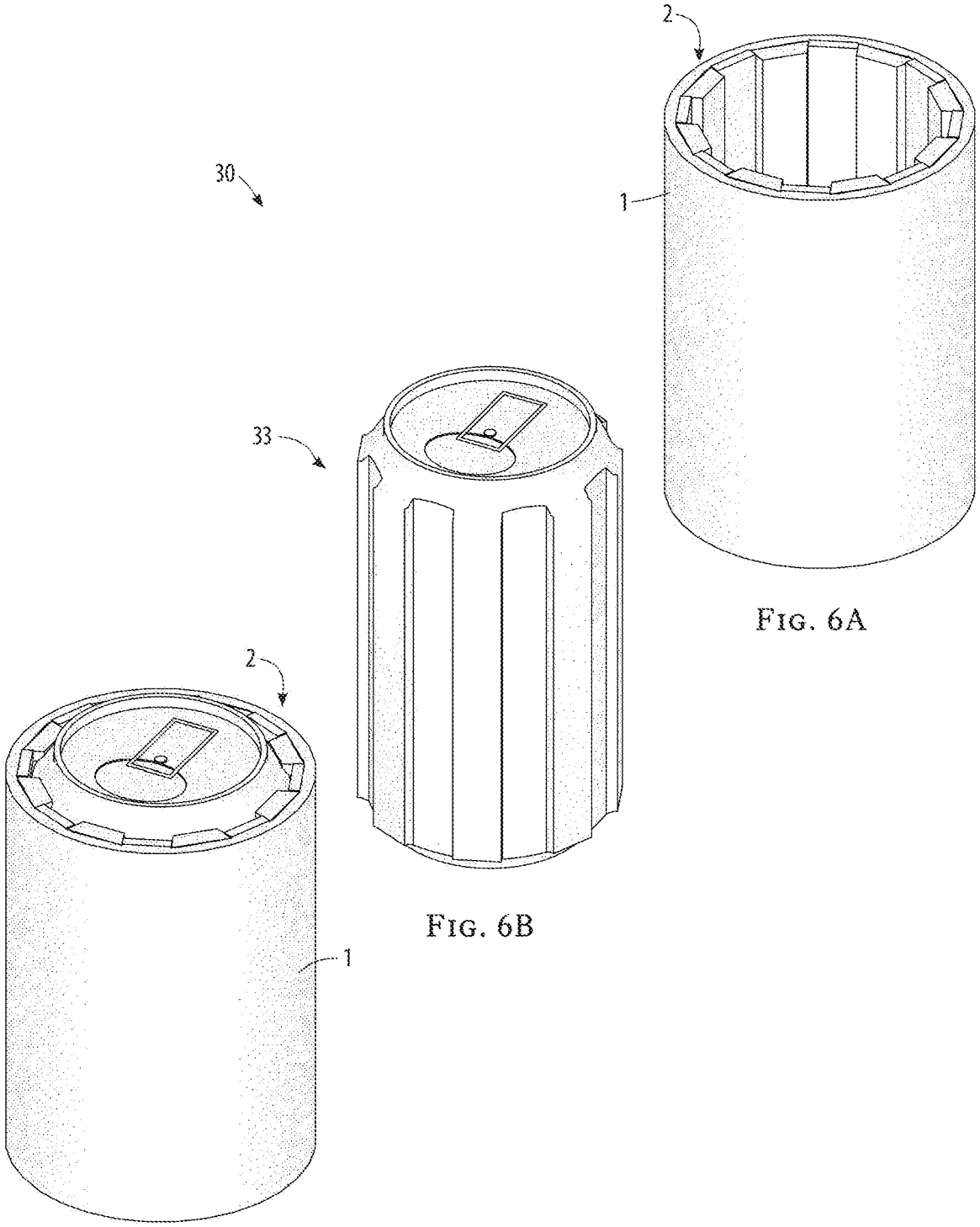
FIGS. 6A through 6C illustrate a stepped-sided container embodiment of the thermal-transfer container sleeve of the invention in use, with FIG. 6A illustrating a matching-container embodiment of the thermal-transfer container sleeve prior to application around a stepped-sided container, FIG. 6B illustrating a sample stepped-sided container, prior to having a matching-container embodiment of the thermal-transfer container sleeve applied to the container, and FIG. 6C illustrating the matching-container embodiment of the thermal-transfer container sleeve in application around a stepped-sided container.

Referring to FIGS. 6A through 6C, a matching-container embodiment 30 of the thermal-transfer container sleeve additionally provides a stepped-sided container 33 that has an increased surface area created by alternating concavities and convexities of the container sides, as shown. This effect can be achieved with a variety of patterns, from smooth undulations to sharper edges. Depending upon the container material and the container's purpose, there may be advantages of mechanical strength or production technique for one pattern over another. In this matching-container embodiment, the configuration of the high-thermal-capacitance units 2 is designed to conform to the pattern of the stepped-sided container 33 such that a maximum amount of close physical and thermal contact is achieved.

It is envisioned just as the system 10 could be used in healthcare application, it could similarly be used in domestic applications such as for example keeping a pizza or a ready-made dinner warm, or keeping items such as cold cuts, fish, meat, and the like cold during transport.

Figure 7:
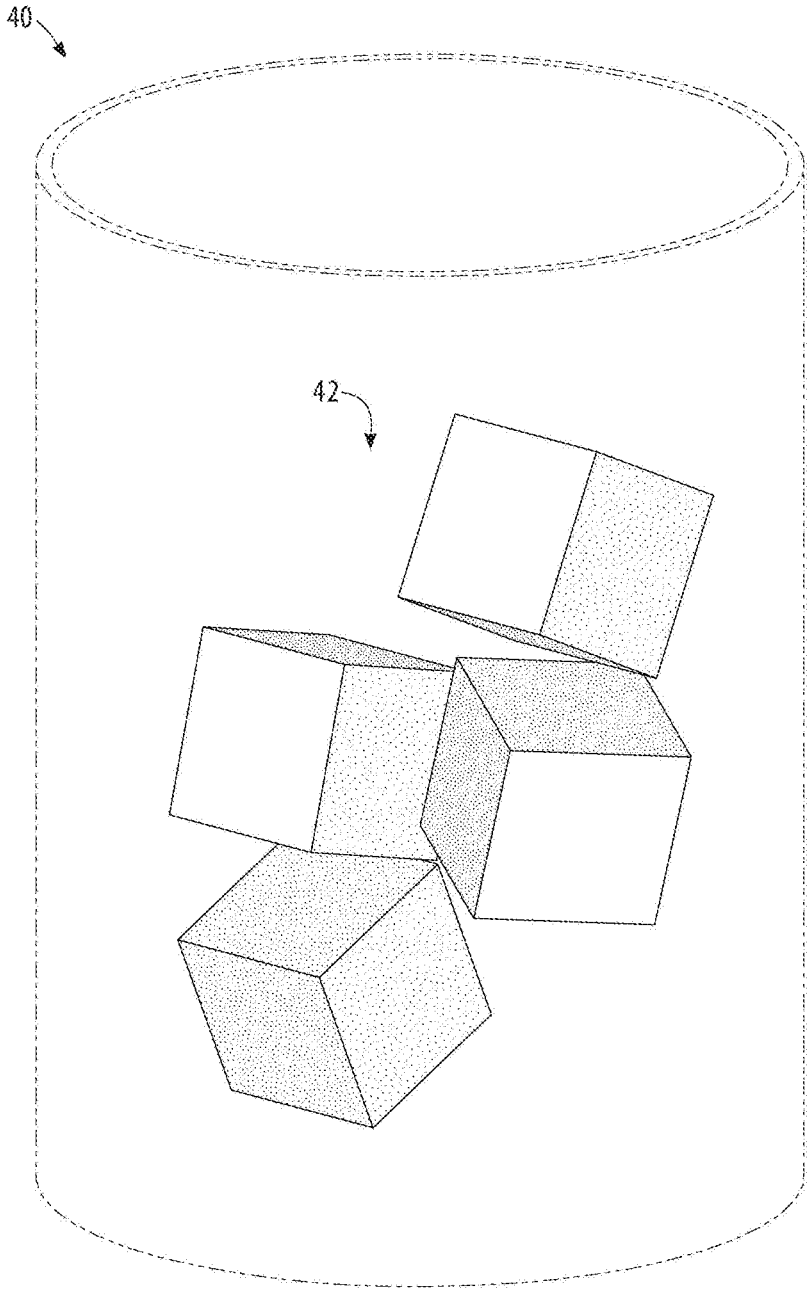
FIG. 7 is a perspective view of an alternative embodiment of the present invention.

Turning now to the alternative embodiment of the present invention shown in FIG. 7, the cooling system comprises a plurality of thermally-conductive units, or members 42. The thermally-conductive units 42, similarly to the units 2, are formed from a solid thermally-conductive material, such as, for instance, ceramics, polymers and others. Such materials have high-melting point and will not melt when exposed to room temperature, as opposed to ice cubes made from water.

Each unit 42 can be formed in a variety of desired configurations, such as cubes, spheres, hollow bodies, solid bodies, and the like. The thermal units 42 can be placed in a freezer to lower their temperature. When removed from the freezer, the thermal units 42 will retain cold for a certain period of time. During that time, they can be placed in a fluid container, such as glass 40 and lower the temperature of the fluid inside the container without diluting the fluid.

It is envisioned that the thermal units 42 will be beneficial in a variety of circumstances. For instance, the thermal units 42 can be used in drinks where addition of water ice cubes would not be desirable. Since the thermal units 42 do not melt, as ice cubes would, the thermal units 42 will cool the liquid without diluting it. Two or more thermal units 42 can be secured together by a flexible connector and removed from the container 42 by lifting one of the "chain" of the thermal units 42. After use, the thermal units 42 can be washed and re-used numerous times.

Many other changes and modifications can be made in the system and method of the present invention without departing from the spirit thereof. I therefore pray that my rights to the present invention be limited only by the scope of the appended claims.

I claim:

1. A thermal-transfer container sleeve method for affecting the temperature of a fluid inside a thermally-conductive container, comprising:

(i) providing a thermal-transfer container sleeve, further comprising:

(a) a plurality of high-thermal capacitance units adapted to transfer thermal energy with an outside heat source or sink, store such thermal energy, and transfer such thermal energy with the fluid inside a thermally-conductive container, and having an inner face adapted for thermal contact with the thermally-conductive container; and (b) an insulating sleeve of thermally-insulating sheet material, having an inner face toward the thermally-conductive container and an opposite outer face, adapted for attachment of said high-thermal-capacitance units on the inner face, and adapted for holding said high-thermal-capacitance units on the inner face; and adapted for holding said high-thermal-capacitance units against the surface of the thermally-conductive container;

where the shape of said high-thermal-capacitance units and configuration of attachment to said insulating sleeve are such that the inner face of each high-thermal-capacitance unit has a curved surface between a plurality of side walls, and when placed upon the thermally-conductive container, each side wall abuts a side wall of an adjacent high-thermal-capacitance unit, and the curved surfaces of the plurality of high-thermal capacitance units form a continuous surface conforming to the shape of, and in continuous contact with, the thermally-conductive container, and when removed from the thermally-conductive container the inner faces of said high-thermal-capacitance units are located further apart; and where no energy source other than the stored thermal energy of said high-thermal-capacitance units is used by said thermal-transfer container sleeve when in use upon the thermally-conductive container; and (ii) using said thermal-transfer container sleeve by first pre-heating or pre-cooling by an outside heat source or sink, and then placing upon the thermally-conductive container of fluid such that the inner faces of said high-thermal-capacitance units are held in thermal contact with the thermally-conductive container by said insulating sleeve.

2. The thermal-transfer container sleeve method of claim 1, where said thermal-transfer container sleeve further comprises sleeve closures adapted to facilitate placement and removal in use.

3. The thermal-transfer container sleeve method of claim 1, where said thermal-transfer container sleeve further comprises an access opening adapted to allow access to an opening in the thermally-conductive container of fluid during use.

4. The thermal-transfer container sleeve method of claim 1, where said insulating sleeve is made of a flexible sheet rubber material.

5. The thermal-transfer container sleeve method of claim 1, where said insulating sleeve is made of a silicone sheet material.

6. The thermal-transfer container sleeve method of claim 1, where said high-thermal-capacitance units are made of metal.

7. The thermal-transfer container sleeve method of claim 1, where said high-thermal-capacitance units are made of ceramic material.

8. The thermal-transfer container sleeve method of claim 1, where said high-thermal-capacitance units are made of copper.

* * * * *